US009287685B2

(12) United States Patent
Aochi et al.

(10) Patent No.: US 9,287,685 B2
(45) Date of Patent: Mar. 15, 2016

(54) SPARK PLUG FOR INTERNAL COMBUSTION ENGINE

(71) Applicant: DENSO CORPORATION, Kariya, Aichi-pref (JP)

(72) Inventors: Takanobu Aochi, Nishio (JP); Takayuki Inohara, Okazaki (JP); Shinichi Okabe, Aichi-ken (JP); Masamichi Shibata, Toyota (JP); Kaori Doi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/651,040

(22) PCT Filed: Dec. 10, 2013

(86) PCT No.: PCT/JP2013/083062

§ 371 (c)(1),
(2) Date: Jun. 10, 2015

(87) PCT Pub. No.: WO2014/092072

PCT Pub. Date: Jun. 19, 2014

(65) Prior Publication Data

US 2015/0318671 A1 Nov. 5, 2015

(30) Foreign Application Priority Data

Dec. 10, 2012 (JP) ..... 2012-269105

(51) Int. Cl.
*H01T 13/20* (2006.01)
*H01T 13/32* (2006.01)

(52) U.S. Cl.
CPC ..... *H01T 13/32* (2013.01)

(58) Field of Classification Search
CPC ..... H01T 13/32; H01T 13/20
USPC ..... 313/141
See application file for complete search history.

(56) References Cited

U.S. PATENT DOCUMENTS 4,851,732 A * 7/1989 Kashiwara ..... H01T 13/32 123/169 EL

FOREIGN PATENT DOCUMENTS

| | | |
|---|---|---|
| JP | 9-148045 | 6/1997 |
| JP | 2009-176503 | 8/2009 |
| JP | 2011-210514 | 10/2011 |

OTHER PUBLICATIONS

International Search Report (7 pages) dated Jan. 21, 2014 issued in corresponding PCT/JP2013/083062 and English translation (1 page).
International Report on patentability (2 pages) dated Jun. 16, 2015, issued in corresponding PCT/JP2013/083062 and English translation (8 pages).

* cited by examiner

*Primary Examiner* — Vip Patel
(74) *Attorney, Agent, or Firm* — Nixon & Vanderhye PC

(57) ABSTRACT

A spark plug for an internal combustion engine has a housing, an insulator, a center electrode, a ground electrode, and a tip projecting portion. The tip projecting portion has an air guiding surface. In the spark plug, when viewed from a plug axial direction, a straight line that connects the center, in the plug circumferential direction, of the erect portion of the ground electrode and a center point of the center electrode is a straight line. An extension line of the air guiding surface is a straight line. A distance between an intersection, between the straight line and the straight line, and the center point of the center electrode is a (positive towards the side moving away from the erect portion. An angle formed by the straight line and the straight line is b. A diameter of the housing is D. At this time, all of $b \geq -67.8 \times (a/D) + 27.4$, $b \leq -123.7 \times (a/D) + 64.5$, $-0.4 \leq (a/D) \leq 0.4$, and $0° < b \leq 90°$ are satisfied.

19 Claims, 11 Drawing Sheets

SPARK PLUG FOR INTERNAL COMBUSTION ENGINE

CROSS-REFERENCE TO RELATED APPLICATION

This application is the U.S. National Phase of International Application No. PCT/JP2013/083062 filed 10 Dec. 2013, which designated the U.S. and claims the benefit of priority from earlier Japanese Patent Application No. 2012-269105 filed on Dec. 10, 2012 the entire descriptions and contents of each of which are incorporated herein by reference.

BACKGROUND

1. Technical Field

The present invention relates to a spark plug for an internal combustion engine that is used in the engine of an automobile and the like.

2. Background Art

A spark plug is often used as an ignition means in an internal combustion engine, such as an engine of an automobile. In the spark plug, a center electrode and a ground electrode are placed so as to oppose each other in an axial direction of the spark plug, and a spark discharge gap is formed therebetween. The spark plug generates a discharge in the spark discharge gap, and uses the discharge to ignite an air-fuel mixture inside a combustion chamber.

Here, airflow, such a swirl flow or a tumble flow, of the air-fuel mixture is formed inside the combustion chamber. Ignitability can be ensured as a result of the airflow suitably flowing through the spark discharge gap as well.

However, depending on the attachment position of the spark plug to the internal combustion engine, a portion of the ground electrode joined to the tip portion of a housing may be disposed on the up-stream side of the airflow in the spark discharge gap. In this case, the airflow inside the combustion chamber may be blocked by the ground electrode, and the airflow near the spark discharge gap may stagnate. When this stagnation occurs, the ignitability of the spark plug may decrease. In other words, the ignitability of the spark plug may vary depending on the attachment position to the internal combustion engine. The use of lean-burn internal combustion engines has been increasing particularly in recent years. However, combustion stability may decrease in such internal combustion engines, depending on the attachment position of the spark plug.

In addition, it is difficult to control the attachment position of the spark plug to the internal combustion engine, or in other words, the position of the ground electrode in a circumferential direction. A reason for this is that the attachment position changes depending on the state of formation of attachment screws in the housing, the degree of tightening of the spark plug during the attachment operation to the internal combustion engine, and the like.

Therefore, to suppress obstruction of airflow by the ground electrode, a configuration in which hole-boring machining is performed on the ground electrode and a configuration in which the ground electrode is joined to the housing by a plurality of thin, plate-shaped members are disclosed in PTL 1.

CITATION LIST

Patent Literature

[PTL 1] JP-A-H09-148045

Technical Problem

However, in the configuration in which hole-forming machining is performed on the ground electrode, disclosed in PTL 1, the strength of the ground electrode may decrease. In addition, if the ground electrode is formed to be thick to prevent the decrease in strength, as a result, the ground electrode more easily obstruct the airflow of the air-fuel mixture.

Furthermore, in the configuration in which the ground electrode is joined to the housing by a plurality of thin, plate-shaped members, also disclosed in PTL 1, a problem occurs in that the shape of the ground electrode becomes complex, the number of manufacturing processes increases, and manufacturing cost increases.

SUMMARY

Thus it is desired to provide a spark plug for an internal combustion engine that is simply configured and is capable of ensuring stable ignitability regardless of attachment position to an internal combustion engine.

An aspect of the present disclosure is a spark plug for an internal combustion engine comprising:

a cylindrical housing having an axial direction;

a cylindrical insulator that is held inside the housing;

a center electrode that is held inside the insulator so that a tip portion projects outwards;

a ground electrode that projects from a tip portion of the housing towards the a side of the housing along the axial direction and forms a spark discharge gap between the ground electrode and the center electrode; and a tip projecting portion that projects from the tip portion of the housing towards the tip side, at a position differing from that of the ground electrode, wherein the tip projecting portion has a flat air guiding surface that faces the ground electrode side in a plug circumferential direction, and when viewed from a plug axial direction, when a straight line that connects the center, in the plug circumferential direction, of the erect portion of the ground electrode standing erect from the housing and a center point of the center electrode is a straight line L, an extension line of the air guiding surface is a straight line M, a distance between an intersection, between the straight line L and the straight line M, and the center point of the center electrode is a, an angle formed by the straight line L and the straight line M is b, a diameter of the housing is D, and the distance a is positive towards the side receding from the erect portion of the ground electrode and negative towards the side approaching the erect portion, all of expression (1) to expression (4) below are satisfied:

$$b \geq -67.8 \times (a/D) + 27.4 \quad (1)$$

$$b \leq -123.7 \times (a/D) + 64.5 \quad (2)$$

$$-0.4 \leq (a/D) \leq 0.4 \quad (3)$$

$$0° < b \leq 90° \quad (4)$$

The above-described spark plug has the above-described tip projecting portion. Therefore, obstruction of the airflow inside the combustion chamber that is flowing towards the spark discharge gap can be prevented, regardless of the position in which the spark plug is attached to the internal combustion engine.

In other words, for example, when the erect portion of the ground electrode is disposed on the upstream side of the spark discharge gap, airflow that has passed the sides of the erect portion of the ground electrode from the upstream side can be guided to the spark discharge gap by the tip projecting portion. In other words, the tip projecting portion can serve as a guide for the airflow, and guide the airflow towards the spark discharge gap (this function is hereafter referred to as a "guidance function", as appropriate). Therefore, stagnation of the airflow near the spark discharge gap can be prevented. As a result, stable ignitability of the spark plug can be ensured.

In addition, the air guiding surface of the tip projecting portion, in particular, is disposed in a state satisfying all of the above-described expression (1) to expression (4). Therefore, when the erect portion of the ground electrode is disposed on the upstream side of the spark discharge gap, the guidance function can be effectively realized. In other words, as a result of all of the above-described expression (1) to expression (4) being satisfied, the air guiding surface of the tip projecting portion can suitably guide the airflow to the spark discharge gap. As a result, a discharged spark can be sufficiently extended and ignitability can be sufficiently ensured, regardless of the attachment position of the spark plug to the internal combustion engine.

In addition, the tip projecting portion can be actualized by a simple configuration in which the tip projecting portion is disposed so as to project towards the tip side from the tip portion of the housing. In other words, the shape of the ground electrode is not required to be particularly modified, nor is a complex shape required.

As described above, according to the above-described aspect, a simply configured spark plug for an internal combustion engine can be provided that is capable of ensuring stable ignitability regardless of the attachment position to the internal combustion engine.

The above-described main configuration can be carried out according to other various aspects.

In the above-described spark plug for an internal combustion engine, the side that is inserted into a combustion chamber is a tip side and the other side is a base side.

For example, the above-described spark plug for an internal combustion engine preferably further satisfies expression (5) below:

$$b \leq -123.4 \times (a/D) + 53.7 \quad (5)$$

In this case, ignitability can be more effectively improved.

In addition, the above-described spark plug for an internal combustion engine preferably further satisfies expression (6) below $$b \geq = -123.1 \times (a/D) + 30.0 \quad (6)$$

In this case, ignitability can be improved with further certainty.

In addition, the tip of the tip projecting portion is preferably positioned in a position equivalent to, or further towards the base side than, the tip of the ground electrode is, and a position equivalent to, or further towards the tip side than, the tip of the insulator is. In this case, size reduction of the spark plug in the plug axial direction can be actualized while ensuring the guidance function of the tip projecting portion. As a result, the tip projecting portion can be prevented from interfering with a piston inside the combustion chamber, while ensuring the ignitability of the spark plug.

In addition, the tip of the tip projecting portion is more preferably further towards the tip side than the tip of the center electrode is, and still more preferably, further towards the tip side than the spark discharge gap is.

In addition, a plug circumferential-direction width of the tip projecting portion at a plug axial-direction position closest to the spark discharge gap is preferably smaller than the erect portion of the ground electrode. In this case, obstruction of the airflow by the tip projecting portion can be more easily prevented, and stagnation of airflow near the spark discharge gap G can be effectively prevented.

Furthermore, the above-described plug circumferential-direction width refers to the width in a tangential direction of a circle of which the center is the center axis of the spark plug, when viewed from the plug axial direction.

In addition, the tip projecting portion preferably projects parallel with the plug axial direction. In this case, stagnated airflow caused by the tip projecting portion can be prevented from being formed near the spark discharge gap. Furthermore, because the shape of the tip projecting portion can be simplified, a simply configured spark plug can be actualized.

Here, the parallel with the plug axial direction also includes when the tip projecting portion is substantially parallel to an extent allowing the above-described effects to be achieved, even should the tip projecting portion be slightly tilted in relation to the plug axial direction.

In addition, of the cross-sectional shape of the tip projecting portion in a plug axial-direction position closest to the spark discharge gap, the plug radial-direction width is preferably longer than the plug circumferential-direction width. In this case, the airflow that is flowing from the upstream side towards the vicinity of the tip portion of the spark plug can be easily and efficiently guided towards the spark discharge gap by the tip projecting portion. In addition, the tip projecting portion does not easily obstruct the airflow that flows from the upstream side towards the vicinity of the tip portion of the spark plug. In other words, when the ground electrode is disposed on the upstream side of the spark discharge gap, the tip projecting portion provides a function for guiding the airflow to the spark discharge gap (guidance function). However, when the tip projecting portion itself is disposed on the upstream side of the spark discharge gap G, depending on the shape thereof, the risk of obstruction of the airflow flowing towards the spark discharge gap can be considered. The above-described guidance function is more easily realized as the plug radial-direction width of the tip projecting portion increases. The effect of obstructing airflow flowing towards the spark discharge gap G more easily occurs as the plug circumferential-direction width of the tip projecting portion increases. Therefore, as a result of the tip projecting portion being shaped so that the plug radial-direction width is larger than the plug circumferential-direction width, introduction of airflow into the spark discharge gap can be more efficiently performed, while preventing obstruction of the airflow flowing towards the spark discharge gap.

In addition, the cross-sectional shape of the tip projecting portion in a plug axial-direction position closest to the spark discharge gap can be a triangle. In this case, the tip projecting portion can be more easily prevented from projecting inward and outward in the plug radial direction from the tip portion of the housing, while forming the air guiding portion that has a wide area in the tip projecting portion. Therefore, the guidance function of the tip projecting portion can be improved while preventing problems regarding lateral flying sparks and problems regarding attachability to the internal combustion engine.

In addition, the above-described spark plug for an internal combustion engine preferably further satisfies expression (7) below:

$$-0.3 \leq (a/D) \leq 0.3 \quad (7)$$

In this case, ignitability can be improved with further certainty.

DESCRIPTION OF EMBODIMENTS

First Example

A first example of a spark plug for an internal combustion engine of the present invention will be described with reference to FIG. 1 to FIG. 4.

Figure 1:
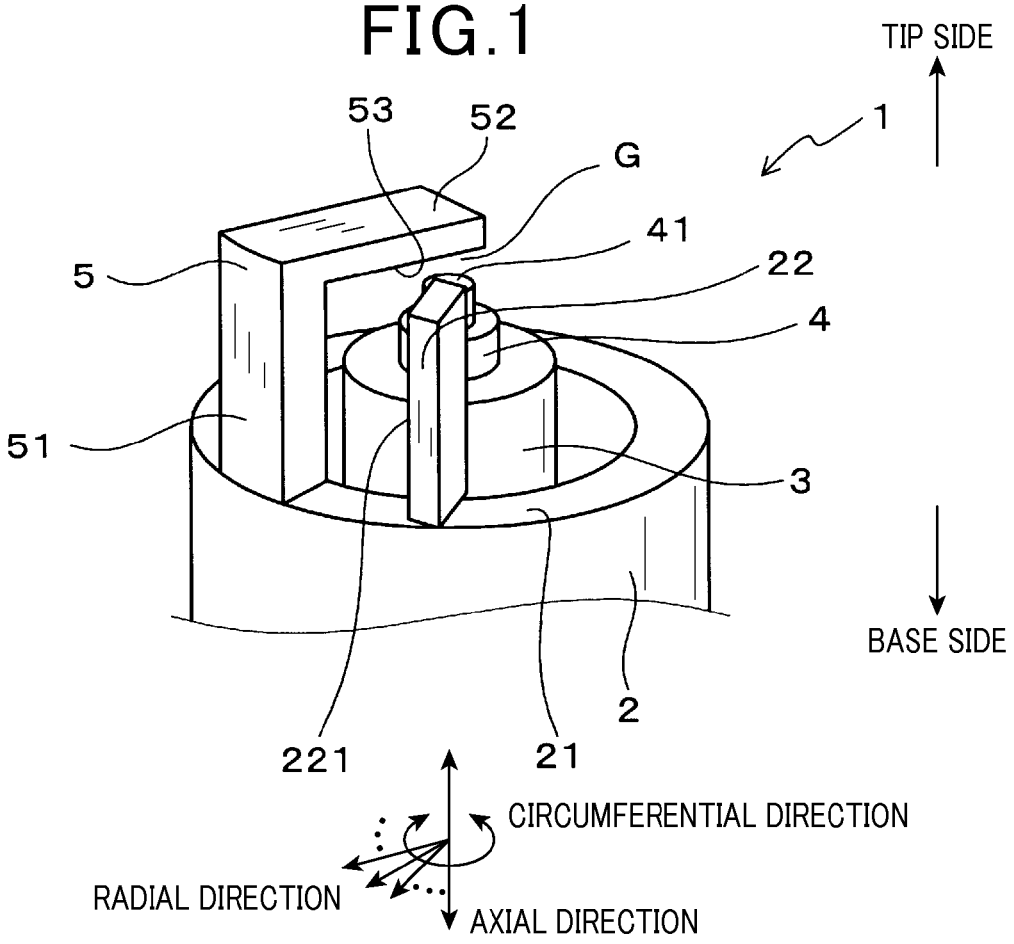
FIG. 1 is a perspective view of a tip portion of a spark plug in a first example.
Figure 2:
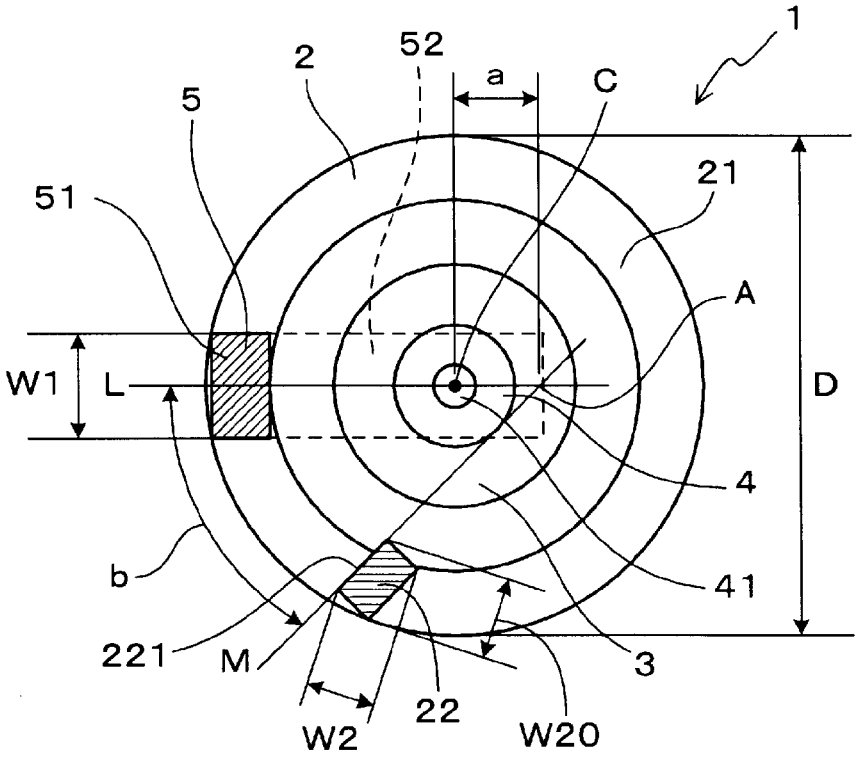
FIG. 2 is a cross-sectional view of the spark plug, in a plug axial-direction position equivalent to that of a spark discharge gap, in the first example.
Figure 3:
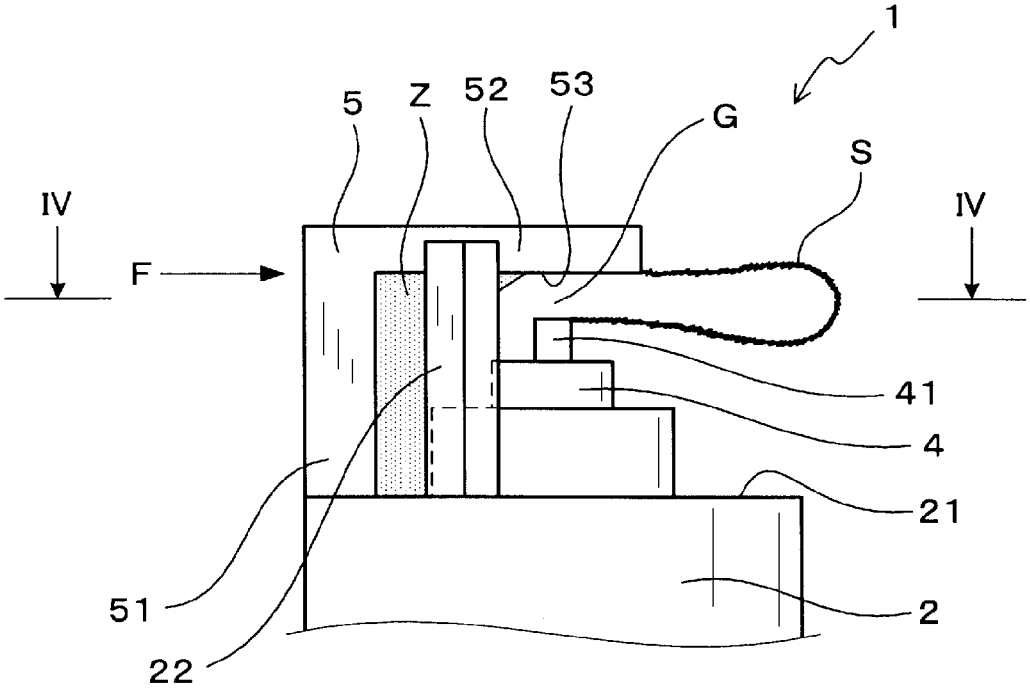
FIG. 3 is a side view of the tip portion of the spark plug when an erect portion of a ground electrode is disposed on the upstream side of airflow, in the first example.

As shown in FIG. 1 to FIG. 3, a spark plug 1 of the present example has a cylindrical housing 2, a cylindrical insulator 3 that is held inside the housing 2, and a center electrode 4 that is held inside the insulator 3 such that the tip portion thereof projects outward. In addition, the spark plug 1 has a ground electrode 5 that projects from the tip portion of the housing 2 towards the tip side and forms a spark discharge gap G between the ground electrode 5 and the center electrode 4.

As shown in FIG. 1, when the length direction of the housing 2 is set as an axial direction, a circumferential direction that circles around the axial direction along the surface of the housing 2 perpendicular to the axial direction, and a radial direction that extends in a radial direction from a center axis that runs along the axial direction of the housing (an axis passing through a position indicated by reference sign C in FIG. 2) are defined. In addition, as shown in FIG. 1, the two sides in the axial direction are defined as a tip side and a base side. The definitions of these directions are not particularly illustrated, but are similarly applied to other examples as well.

As shown in FIG. 1 and FIG. 3, the ground electrode 5 has an erect portion 51 that stands erect from a tip portion 21 of the housing 2 towards the tip side, and an opposing portion 52 that bends from the tip of the erect portion 51. The opposing portion 52 is provided with an opposing surface 53 that opposes a tip portion 41 of the center electrode 4 in the plug axial direction.

The spark plug 1 has a tip projecting portion 22 that projects from the tip portion 21 of the housing 2 towards the tip side, in a position differing from that of the ground electrode 5.

The tip projecting portion 22 has a flat air guiding surface 221 that faces the ground electrode 5 side in the plug circumferential direction.

As shown in FIG. 2, when viewed from the plug axial direction, the spark plug 1 satisfies all of the relational expression (1) to expression (4) under the following conditions.

In other words, when viewed from the plug axial direction, a straight line that connects the center, in the plug circumferential direction, of the erect portion 51 of the ground electrode 5 standing erect from the housing 2 and a center point C of the center electrode 4 is a straight line L. An extension line of the air guiding surface 221 is a straight line M. The distance between an intersection A, between the straight line L and the straight line M, and the center point C of the center electrode is a. An angle formed by the straight line L and the straight line M is b. The diameter of the housing 2 is D. In addition, the distance a is positive towards the side moving away from the erect portion 51 of the ground electrode 5, and negative towards the side approaching the erect portion 51. At this time, a, b, and D satisfy all relationships in the following expression (1) to expression (4).

$$b \geq -67.8 \times (a/D) + 27.4 \quad (1)$$

$$b \leq -123.7 \times (a/D) + 64.5 \quad (2)$$

$$-0.4 \leq (a/D) \leq 0.4 \quad (3)$$

$$0° < b \leq 90° \quad (4)$$

Furthermore, the spark plug 1 also preferably satisfies at least one of the following expression (5) and expression (6), and more preferably satisfies both expression (5) and expression (6), in addition to satisfying all of the above-described expression (1) to expression (4).

$$b \leq -123.4 \times (a/D) + 53.7 \quad (5)$$

$$b \geq -123.1 \times (a/D) + 30.0 \quad (6)$$

Still further, the following expression (7) is also more preferably satisfied $$-0.3 \leq (a/D) \leq 0.3 \quad (7)$$

In addition, as shown in FIG. 1 and FIG. 3, the tip projecting portion 22 projects parallel with the plug axial direction.

Furthermore, the tip of the tip projecting portion 22 is positioned in a position equivalent to, or further towards the base side than, the tip of the ground electrode 5 is, and a position equivalent to, or further towards the tip side than, the tip of the insulator 3 is. The ground electrode 5 is disposed so that the erect portion 51 is parallel with the plug axial direction and the opposing portion 52 is parallel with the plug radial direction.

As shown in FIG. 2, a plug circumferential-direction width of the tip projecting portion 22 in a plug axial-direction position closest to the spark discharge gap G is smaller than that of the ground electrode 5. In the case of the present example, the "plug axial-direction position closest to the spark discharge gap G" of the tip projecting portion 22 is the same plug axial-direction position as that of the spark discharge gap G. Therefore, a plug circumferential-direction width W2 of the tip projecting portion 22 in the plug axial-direction position equivalent to that of the spark discharge gap G is smaller than a plug circumferential-direction width W1 of the erect portion 51 of the ground electrode 5.

In addition, of the cross-sectional shape of the tip projecting portion 22 in the plug axial-direction position closest to the spark discharge gap G, a plug radial-direction width W20 is longer than the plug circumferential-direction width W2. In the present example, of the cross-sectional shape in the plug axial-direction position equivalent to that of the spark discharge gap G, the plug radial-direction width W20 is longer than the plug circumferential-direction width W2.

In addition, the tip projecting portion 22 has the air guiding surface 221 that faces the ground electrode 5 side in the plug circumferential direction. Here, "faces the ground electrode 5 side" means facing towards the erect portion 51 of the ground electrode 5 in the plug circumferential direction along the tip portion 21 of the housing 2. When viewed from the plug axial direction, the extension line (straight line M) of the air guiding surface 221 is not necessarily required to pass through the spark discharge gap G (tip portion 41 of the center electrode 4). In other words, the orientation and position of the straight line M can be set within a range satisfying the above-described expression (1) to expression (4). Furthermore, the ground electrode 5 is preferably disposed so that the straight line M is drawn to be oriented and positioned to also satisfy expression (5), expression (6), or expression (7).

In addition, as shown in FIG. 1 and FIG. 2, the tip projecting portion 22 has a quadrangular columnar shape of which the shape of the cross-section formed by a surface perpendicular to the plug axial direction is a rectangle. One of the faces configuring the length side of the rectangle is the above-described air guiding surface 221.

In addition, an example of the dimensions and the materials of each section in the present example is described below.

The diameter D of the housing 2 is 10.2 mm, and the thickness at the tip portion 21 of the housing 2 is 1.4 mm. In addition, the plug radial-direction width W2 of the tip projecting portion 22 is 1.9 mm, and the plug circumferential-direction width W20 is 1.3 mm. Furthermore, the plug circumferential-direction width W1 of the erect portion 51 of the ground electrode 5 is 2.6 mm.

Moreover, the tip portion 41 of the center electrode 4 projects 1.5 mm from the tip of the insulator 3, in the axial direction. The spark discharge gap G is 1.1 mm.

In addition, the tip portion 41 of the center electrode 4 is configured by a noble-metal tip composed of iridium. Furthermore, the housing 2 and the ground electrode 5 are composed of a nickel alloy.

The above-described dimensions and materials are also the specific dimensions and materials of the samples used in an experiment example 1, described hereafter.

However, in the above-described spark plug 1, the dimensions and materials of each section are not particularly limited.

The spark plug 1 of the present example is used in an internal combustion engine for a vehicle, such as an automobile.

Next, the working effects of the present example will be described.

The above-described spark plug 1 has the tip projecting portion 22. Therefore, obstruction of the airflow inside the combustion chamber that is flowing towards the spark discharge gap G can be prevented, regardless of the position in which the spark plug 1 is attached to the internal combustion engine.

Figure 4:
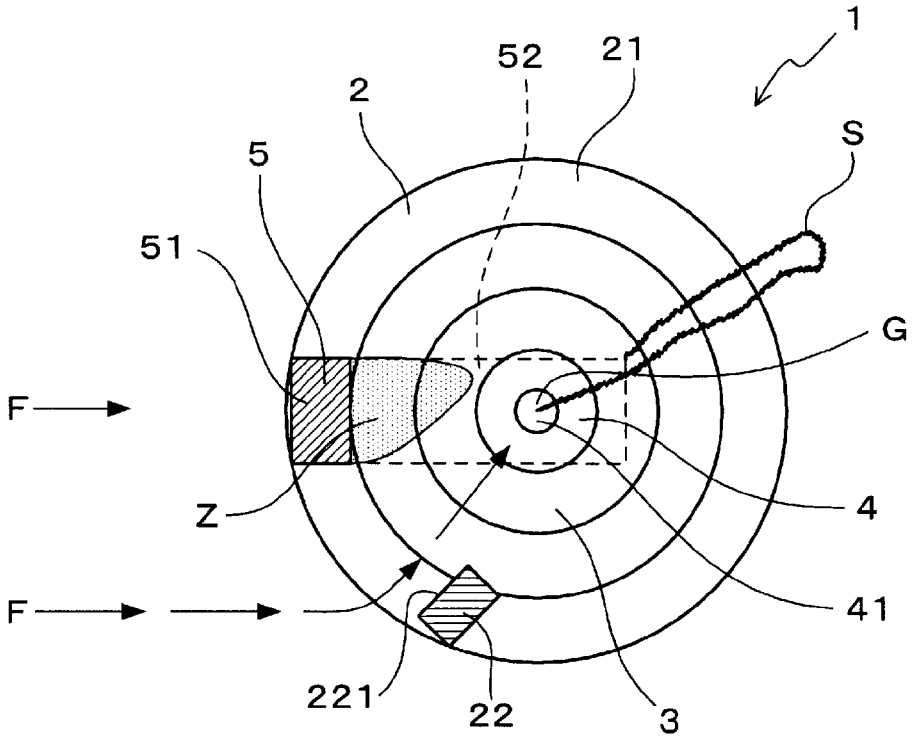
FIG. 4 is a cross-sectional view taken along line IV-IV in FIG. 3.

In other words, for example, as shown in FIG. 3 and FIG. 4, when the erect portion 51 of the ground electrode 5 is disposed on the upstream side of the spark discharge gap G, airflow F that has passed the sides of the erect portion 51 of the ground electrode 5 from the upstream side can be guided to the spark discharge gap G by the tip projecting portion 22. In other words, the tip projecting portion 22 can serve as a guide for the airflow F, and guide the airflow F towards the spark discharge gap G. Therefore, stagnation of the airflow F near the spark discharge gap G can be prevented. As a result, stable ignitability of the spark plug 1 can be ensured. In FIG. 3 and FIG. 4, the area indicated by reference sign Z indicates the stagnation of airflow F. The same applies to other drawings.

The air guiding surface 221 of the tip projecting portion 22, in particular, is disposed in a state satisfying all of the above-described expression (1) to expression (4). Therefore, when the erect portion 51 of the ground electrode 5 is disposed on the upstream side of the spark discharge gap G, a guidance function can be effectively realized. In other words, as a result of all of the above-described expression (1) to expression (4) being satisfied, the air guiding surface 221 of the tip projecting portion 22 can suitably guide the airflow F to the spark discharge gap G. As a result, a discharged spark S can be sufficiently extended and ignitability can be sufficiently ensured, regardless of the attachment position of the spark plug 1 to the internal combustion engine.

In addition, the tip projecting portion 22 can be actualized by a simple configuration in which the tip projecting portion 22 is disposed so as to project towards the tip side from the tip portion 21 of the housing 2. In other words, the shape of the ground electrode 5 is not required to be particularly modified, nor is a complex shape required.

In addition, ignitability can be more effectively improved as a result of the spark plug 1 further satisfying the above-described expression (5) or expression (6), in addition to the above-described expression (1) to expression (4). More preferably, ignitability can be improved with further certainty as a result of the spark plug 1 further satisfying the above-described expression (5) and expression (6), in addition to the above-described expression (1) to expression (4).

In addition, the tip of the tip projecting portion 22 is positioned in a position equivalent to, or further towards the base side than, the tip of the ground electrode 5 is, and a position equivalent to, or further towards the tip side than, the tip of the insulator 3 is. Therefore, size reduction of the spark plug 1 in the plug axial direction can be actualized while ensuring the guidance function of the tip projecting portion 22. As a result, the tip projecting portion 22 can be prevented from interfering with a piston inside the combustion chamber, while ensuring the ignitability of the spark plug 1.

In addition, the plug circumferential-direction width W2 of the tip projecting portion 22 is smaller than the plug circumferential-direction width W1 of the erect portion 51 of the ground electrode 5. Therefore, obstruction of the airflow F by the tip projecting portion 22 can be more easily prevented, and stagnation of airflow near the spark discharge gap G can be effectively prevented.

In addition, the tip projecting portion 22 projects parallel with the plug axial direction. Therefore, stagnant airflow caused by the tip projecting portion 22 can be prevented from being formed near the spark discharge gap G. Furthermore, because the shape of the tip projecting portion 22 can be simplified, a simply configured spark plug 1 can be actualized.

In addition, of the cross-sectional shape of the tip projecting portion 22, the plug radial-direction width W20 is longer than the plug circumferential-direction width W2. Therefore, the airflow F that is flowing from the upstream side towards the vicinity of the tip portion of the spark plug 1 can be easily and efficiently guided towards the spark discharge gap G by the tip projecting portion 22. In addition, the tip projecting portion 22 does not easily obstruct the airflow that flows from the upstream side towards the vicinity of the tip portion of the spark plug 1. In other words, when the ground electrode 5 is disposed on the upstream side of the spark discharge gap G, the tip projecting portion 22 provides the guidance function for guiding the airflow to the spark discharge gap G. However, when the tip projecting portion 22 itself is disposed on the upstream side of the spark discharge gap G, depending on the shape thereof, the risk of obstruction of the airflow flowing towards the spark discharge gap G can be considered. The above-described guidance function is more easily realized as the plug radial-direction width W20 of the tip projecting portion 22 increases. The effect of obstructing airflow flowing towards the spark discharge gap G more easily occurs as the plug circumferential-direction width W2 of the tip projecting portion 22 increases. Therefore, as a result of the tip projecting portion 22 being shaped so that the plug radial-direction width W20 is larger than the plug circumferential-direction width W2, introduction of airflow into the spark discharge gap G can be more efficiently performed, while preventing obstruction of the airflow flowing towards the spark discharge gap G.

As described above, in the present example, a simply configured spark plug for an internal combustion engine can be provided that is capable of ensuring stable ignitability regardless of the attachment position to the internal combustion engine.

Comparative Example 1

As shown in FIG. 5 to FIG. 8, the present example is an example of an ordinary spark plug 9 in which a ground electrode 95 is configured by an erect portion 951 and an opposing portion 952.

Figure 5:
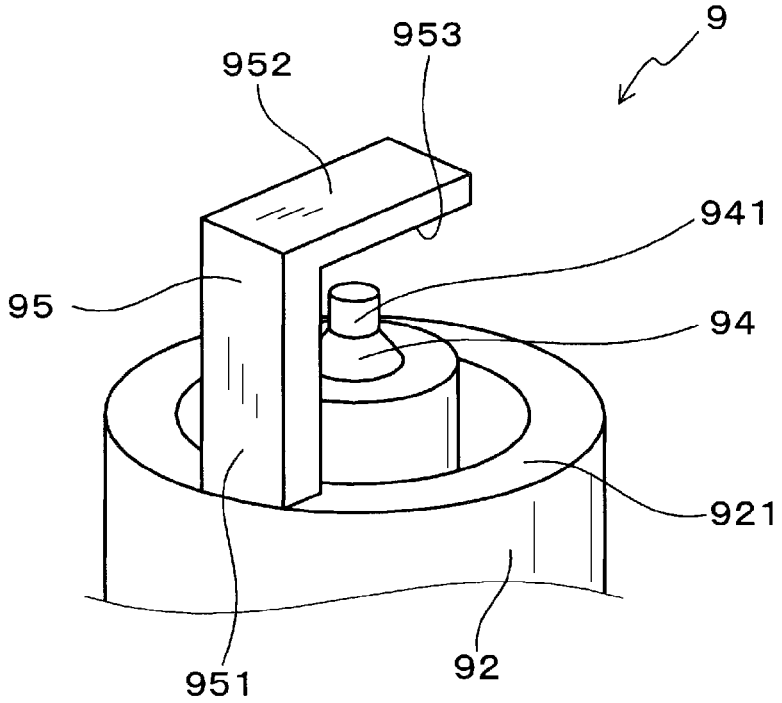
FIG. 5 is a perspective view of the tip portion of the spark plug in a comparative example 1.
Figure 6:
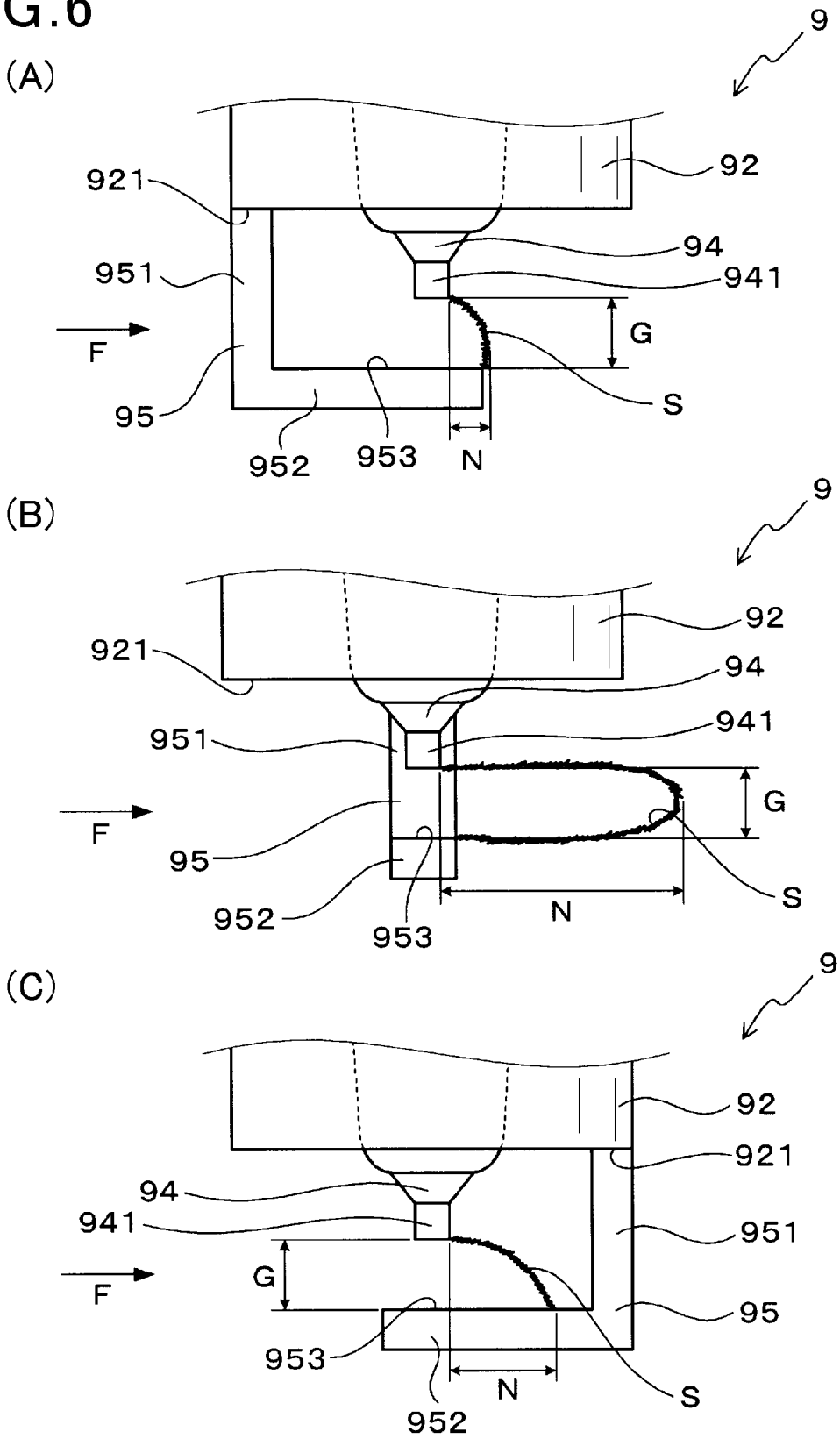
FIG. 6(A) is an explanatory diagram of discharge when the erect portion of the ground electrode is disposed on the upstream side, (B) is an explanatory diagram of discharge when the erect portion of the ground electrode is disposed in a position perpendicular to the airflow, and (C) is an explanatory diagram of discharge when the erect portion of the ground electrode is disposed on the downstream side, in the comparative example 1.

As shown in FIG. 5, the ground electrode 95 has the erect portion 951 that stands erect from a tip surface 921 of a housing 92 towards the tip side, and the opposing portion 952 that bends from the tip of the erect portion 951. The opposing portion 952 has an opposing surface 953 that opposes a tip portion 941 of a center electrode 94 in the plug axial direction.

In other words, the spark plug 9 does not have a configuration like that in the first example in which the tip projecting portion 22 that projects from the housing tip portion towards the tip side is disposed (see FIG. 1).

The spark plug 9 is similar to that in the first example regarding other aspects.

In the present example, when the spark plug 9 is attached to an internal combustion engine and used, as shown in FIG. 6(A) to (C), a discharge length N of the discharged spark S in the spark discharge gap G significantly changes depending on the attachment orientation of the spark plug 9. A reason for this is the relationship with the direction of airflow F within the combustion chamber.

In other words, as shown in FIG. 6(A), when the spark plug 9 is attached to the internal combustion engine so that the erect portion 951 of the ground electrode 95 is disposed on the upstream side of the spark discharge gap G, the discharge length N is very short.

On the other hand, as shown in FIG. 6(B), when the spark plug 9 is attached to the internal combustion engine so that the position of the erect portion 951 of the ground electrode 95 in relation to the spark discharge gap G is disposed in a position perpendicular to the direction of airflow F, the discharge length N is very long.

In addition, as shown in FIG. 6(C), when the spark plug 9 is attached to the internal combustion engine so that the erect portion 951 of the ground electrode 95 is disposed on the downstream side of the spark discharge gap G, the discharge length N becomes long to a certain degree, but is shorter than that shown in FIG. 6(B), described above.

Here, the discharge length N refers to the length of discharge in the direction perpendicular to the axial direction of the spark plug.

The manner in which the above-described discharge length N varies is information that has been obtained by measuring the discharge length N of the discharged spark S generated in the spark discharge gap G with the flow rate of airflow F at 15 m/s. Specifically, as shown in FIG. 7, significant differences in the discharge length N occurred depending on each attachment position of the spark plug 9.

Figure 7:
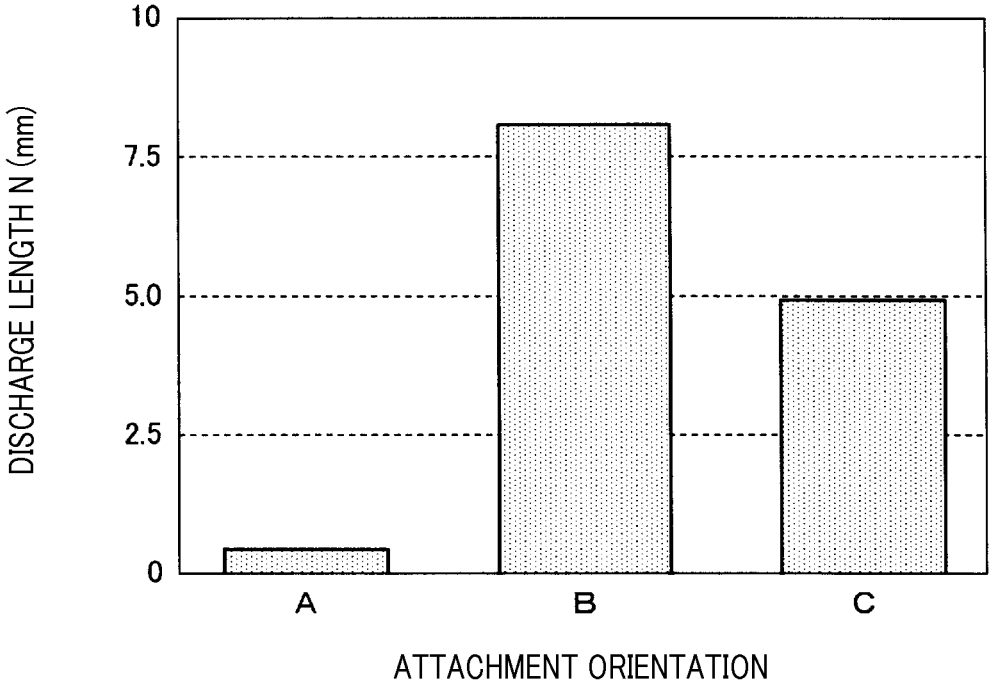
FIG. 7 is a comparison graph of discharge lengths in the comparative example 1.

A, B, and C in FIG. 7 indicate the data regarding discharge length N at each attachment position shown in FIGS. 6(A), (B), and (C).

Figure 8:
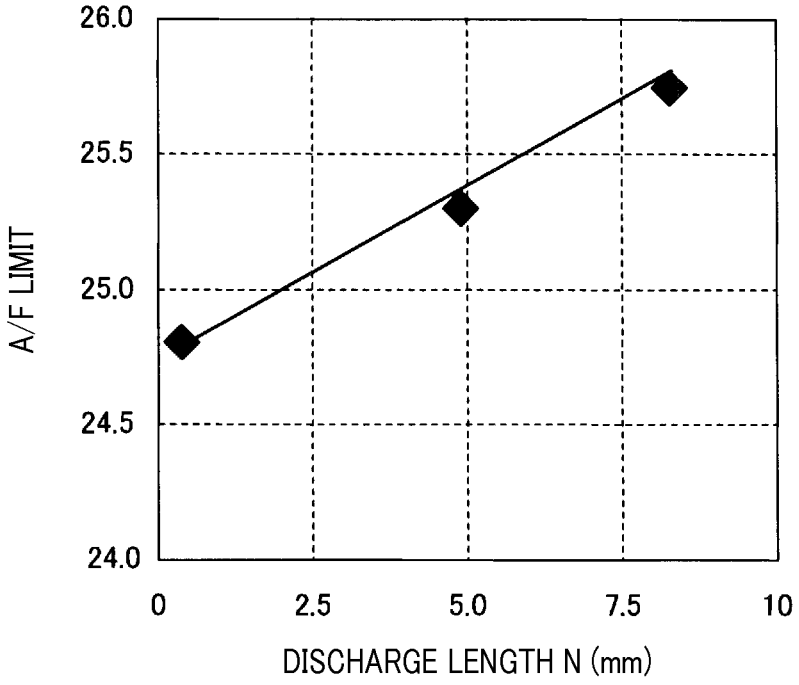
FIG. 8 is a line chart of the relationship between discharge length and A/F limit, in the comparative example 1.

In addition, as shown in FIG. 8, regarding the relationship between the discharge length N and the ignition performance of the spark plug 9, it has been confirmed that the ignition performance improves as the discharge length N increases. Here, the ignition performance is evaluated by the A/F limit, or in other words, the limit value of air-fuel ratio allowing the air-fuel mixture to be ignited. The ignition performance becomes higher as the A/F limit becomes higher (as the ignitable air-fuel mixture becomes leaner).

As FIG. 7 and FIG. 8 indicate, the ignition performance of the spark plug 9 of the comparative example 1 significantly varies depending on the attachment position to the internal combustion engine.

Figure 9:
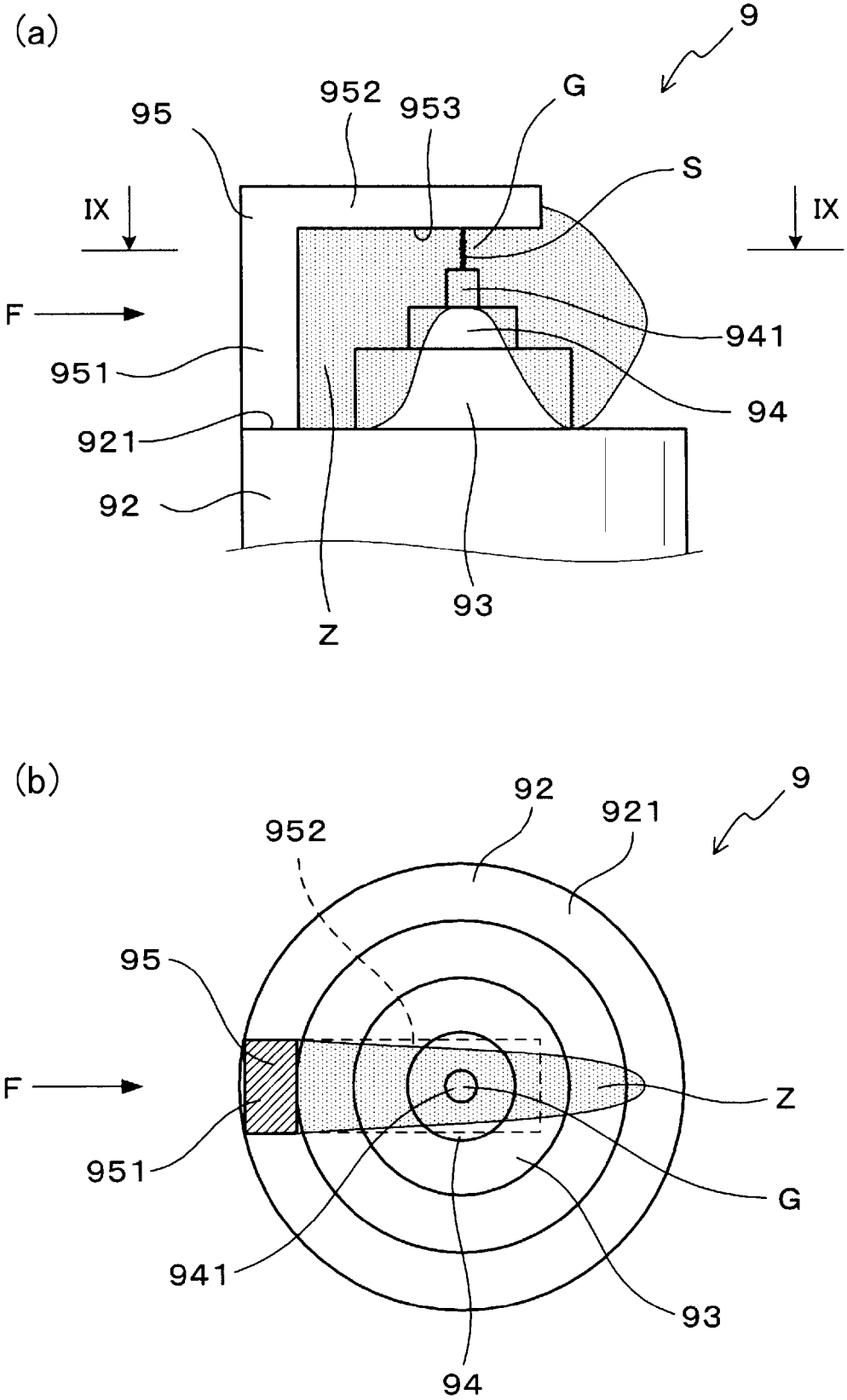
FIG. 9(*a*) is a side-view explanatory diagram of when the erect portion of the ground electrode is disposed on the upstream side of the airflow in the comparative example 1, and (b) is a cross-sectional view taken along line IX-IX in (a)

When the erect portion 951 of the spark plug 9 is disposed on the upstream side of the spark discharge gap G, the discharge length N becomes extremely short, and ignitability decreases. A reason for this is thought to be that, as shown in FIGS. 9(*a*) and (*b*), the airflow F is blocked throughout the overall area of the erect portion 951, and the airflow F near the spark discharge gap G stagnates. More specifically, when the spark discharge gap G is included in the stagnant airflow F, which is the area indicated by reference sign Z in the same drawings, the discharged spark S does not easily extend, and a sufficient discharge length N cannot be obtained (see FIG. 6). As a result, the spark plug 9 has difficulty obtaining stable ignition performance.

Experiment Example 1

Figure 10:
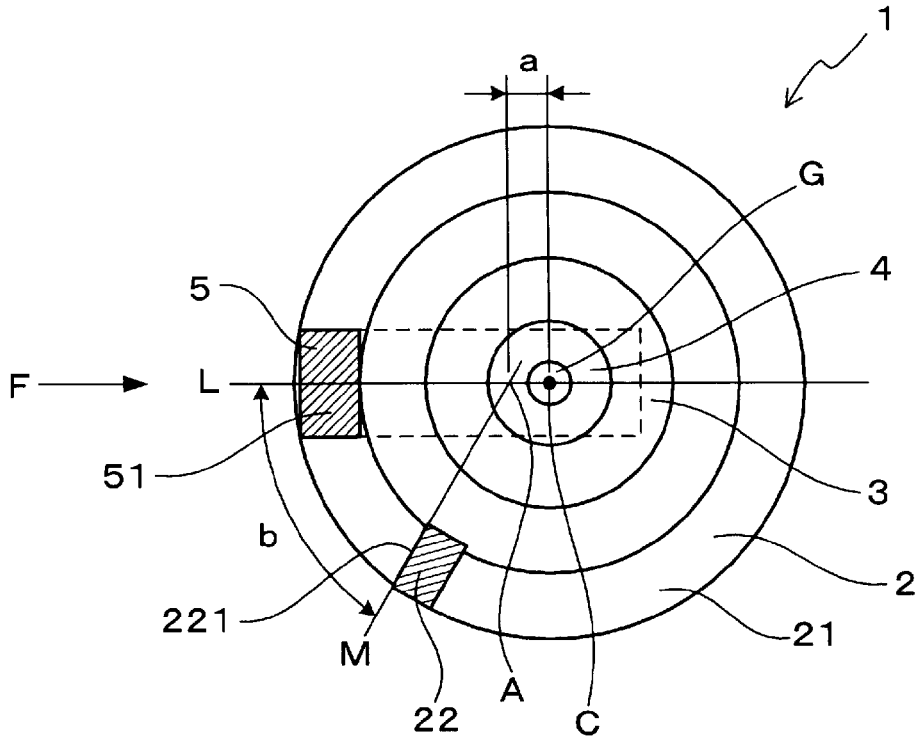
FIG. 10 is a cross-sectional view of an example of the tip portion of the spark plug used in an experiment example 1.
Figure 11:
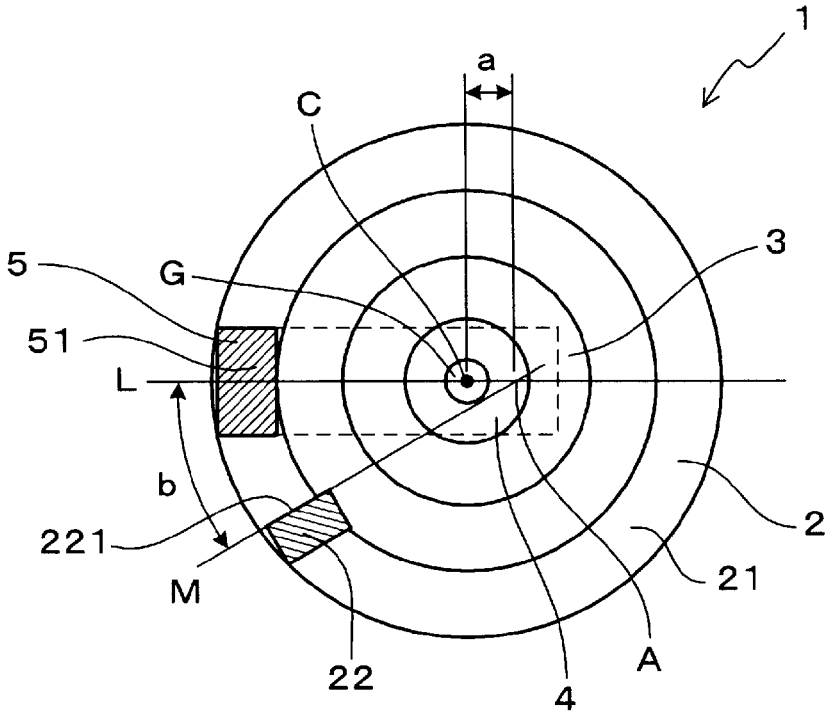
FIG. 11 is a cross-sectional view of another example of the tip portion of the spark plug used in the experiment example 1.
Figure 12:
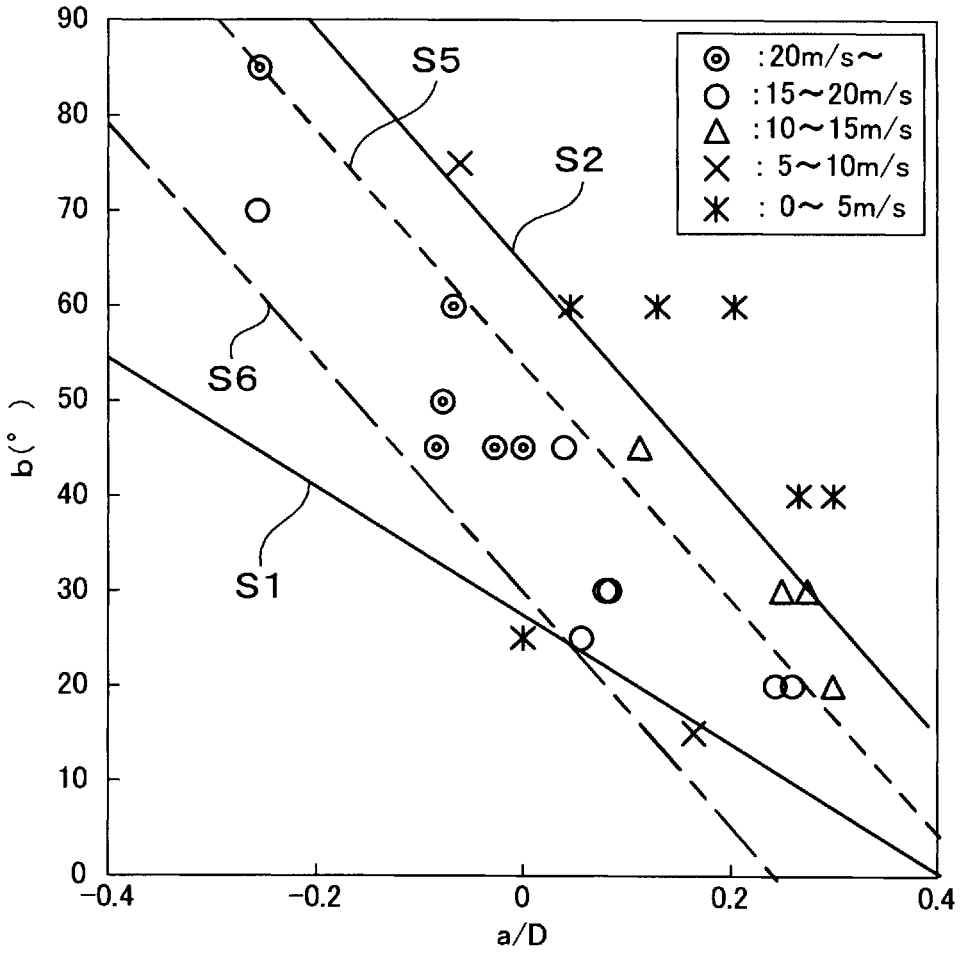
FIG. 12 is a graph of test results in the experiment example 1.

As shown in FIG. 10 to FIG. 12, the present example is an example in which, with the spark plug 1 of the first example as the basic structure, the distance a and the angle b are each variously changed, and the ignitability with these changes are indirectly evaluated.

In other words, as described above, various spark plugs for which the distance a and the angle b have been changed were each set in a combustion chamber so that the erect portion 51 of the ground electrode 5 is disposed on the upstream side of an airflow having a flow rate of 20 m/s. In other words, the spark plugs were set so that the relationship with the airflow F is the state shown in FIG. 3 and FIG. 4. Here, the straight line L is parallel with the direction of airflow F. The flowrate of airflow in the spark discharge gap G at this time was measured.

The discharge length becomes shorter as the flow rate of airflow in the spark discharge gap G decreases. However, because it has been confirmed that the ignitability decreases as the discharge length becomes shorter (see FIG. 8), the ignitability can be indirectly evaluated by the flow rate of airflow in the spark discharge gap G being measured.

The spark plugs shown in FIG. 10 and FIG. 11 are examples in which the distance a and the angle b have been changed in the spark plug 1 indicated in the first example. In addition to these examples, samples in which the tip projecting portion 22 is disposed in various positions and orientations were prepared and evaluated.

The results thereof are shown in FIG. 12.

In FIG. 12, the horizontal axis indicates the ratio (a/D) of the distance a to the diameter D of the housing 2, and the vertical axis indicates the angle b [°]. In this graph, the relationship between a/D and b in each spark plug was plotted. Regarding the plots, a spark plug in which the flow rate of airflow in the spark discharge gap G is 20 m/s or higher is indicated by a double-circle symbol; a spark plug in which the flow rate is 15 m/s or higher and less than 20 m/s is indicated by a circle symbol; a spark plug in which the flow rate is 10 m/s or higher and less than 15 m/s is indicated by a triangle symbol; a spark plug in which the flow rate is 5 m/s or higher and less than 10 m/s is indicated by an x symbol; and a spark plug in which the flow rate is less than 5 m/s is indicated by an asterisk symbol.

The flow rate of the airflow was measured at twelve locations on the center axis of the center electrode 4 in the spark discharge gap G. Evaluation was conducted using the flow rate of the portion having the highest flow rate among the locations.

In addition, in FIG. 12, a straight line S1 indicates that $b=-67.8\times(a/D)+27.4$; a straight line S2 indicates that $b=-123.7\times(a/D)+64.5$; a straight line S5 indicates that $b\leq-123.4\times(a/D)+53.7$; and a straight line S6 indicates that $b\geq-123.1\times(a/D)+30.0$. In other words, the above-described equations respectively indicated by the straight lines S1, S2, S5, and S6 are equations in which the inequality signs in expression (1), expression (2), expression (5), and expression (6) have each been changed to equal signs. Furthermore, the overall area of the graph in FIG. 12 is the range indicated by expression (3) and expression (4).

In FIG. 12, only the double-circle symbols, the circle symbols, and the triangle symbols are plotted in the area between the straight line S1 and the straight line S2. No x symbols or asterisk symbols are present. On the other hand, the x symbols and the asterisk symbols are present outside of the area between the straight line S1 and the straight line S2. In other words, as a result of the plot being in the area between the straight line S1 and the straight line S2, a flow rate of 10 m/s or higher, or in other words, 50% or higher of the flow rate (20 m/s) of the main flow of the airflow supplied near the tip portion of the spark plug can be ensured. From this result, it is clear that, as a result of expression (1) and expression (2) being satisfied, the flow rate of airflow in the spark discharge gap G can be sufficiently ensured. As a premise of the above-described experiment, it is required that expression (3) and expression (4) be satisfied. Therefore, it can be said that, as a result of all of the expression (1) to expression (4) being satisfied, sufficient airflow can be ensured in the spark discharge gap G.

In addition, in FIG. 12, only the double-circle symbols and the circle symbols are plotted in the area below the straight line S5, even within the area between the straight line S1 and the straight line S2. On the other hand, the triangular symbols are present in the area above the straight line S5. In other words, as a result of the plot being in the area between the straight line S1 and the straight line S5, a flow rate of 15 m/s or higher, or in other words, 75% or higher of the flow rate (20 m/s) of the main flow of the airflow supplied near the tip portion of the spark plug can be ensured. From this result, it is clear that, as a result of expression (5) being further satisfied in addition to expression (1) to expression (4), the flow rate of airflow in the spark discharge gap G can be improved.

Furthermore, in FIG. 12, the double-circle symbols and the circle symbols are concentrated only in the area above the straight line S6, even within the area between the straight line S1 and the straight line S2. In other words, as an area in which a flow rate of 10 m/s or higher (50% or higher of the flow rate of the main flow) can be obtained with further certainty, the area above-the straight line S6 can be considered, even within the area between the straight line S1 and the straight line S2. From this result, it is clear that, as a result, of expression (6) being satisfied in addition to expression (1) to expression (4), a sufficient flow rate of the airflow in the spark discharge gap G can be obtained with further certainty.

In addition, from a similar perspective, it can be considered that, as a result of the following expression (7) being further satisfied, a sufficient flow rate of the airflow in the spark discharge gap G can be obtained with further certainty.

$$-0.3\leq(a/D)\leq0.3 \quad (7)$$

Second Example

Figure 13:
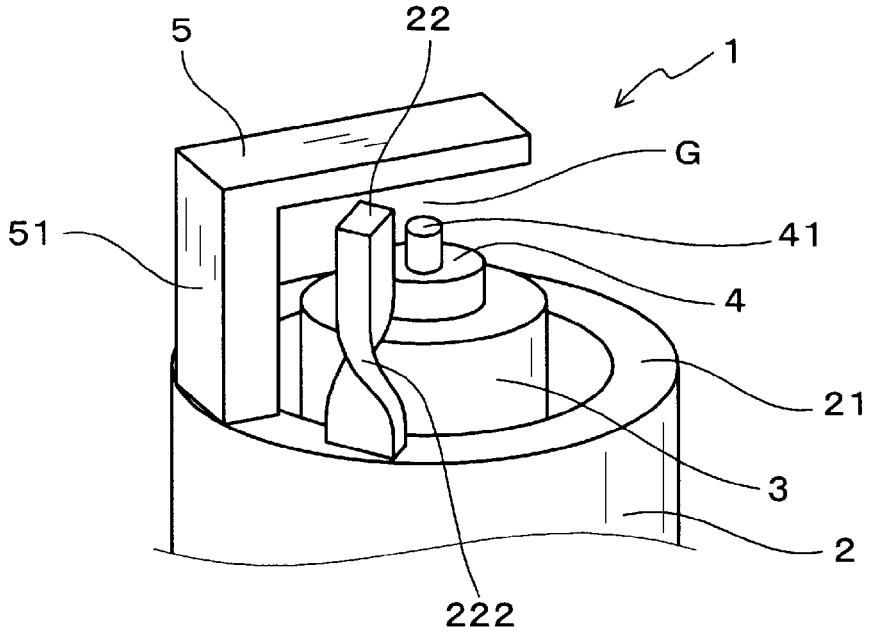
FIG. 13 is a perspective view of the tip portion of the spark plug in a second example.
Figure 14:
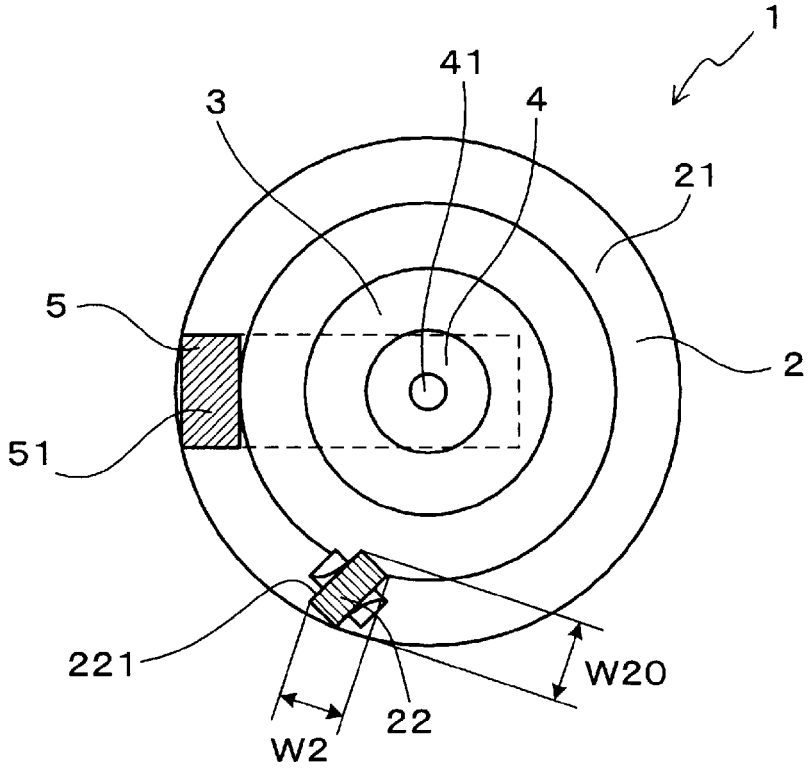
FIG. 14 is a cross-sectional view of the spark plug in the plug axial direction position equivalent to that of the spark discharge gap, in the second example.
Figure 15:
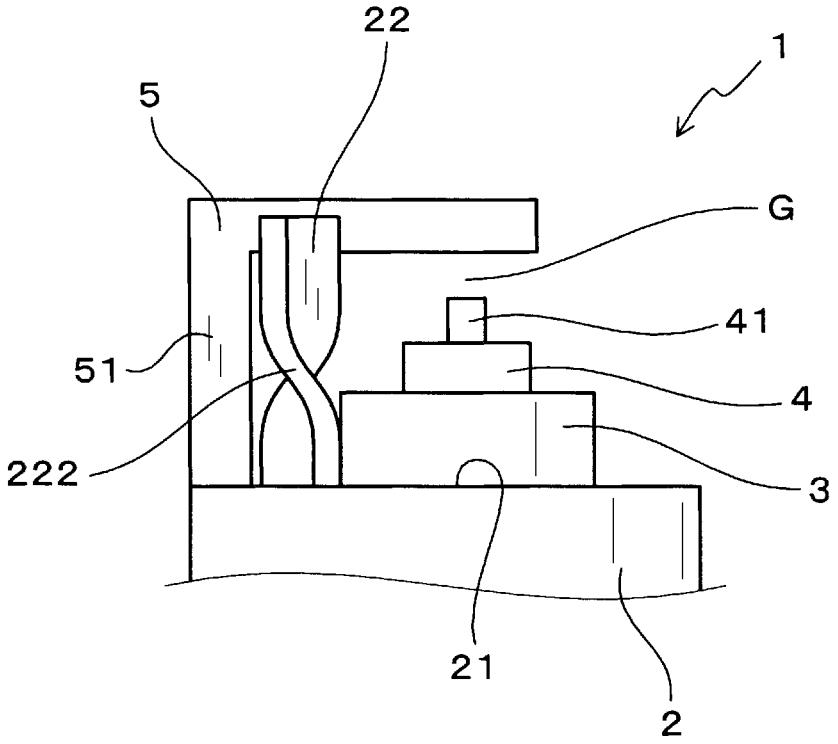
FIG. 15 is a side view of the tip portion of the spark plug in the second example.

As shown in FIG. 13 to FIG. 15, the present example is an example in which the tip projecting portion 22 is provided with a twist portion 222.

In other words, the tip projecting portion 22 has the twist portion 222 in a plug axial-direction position between a base portion and a portion that configures the air guiding surface 221. The base portion is joined to the tip portion 21 of the housing 2. The tip projecting portion 22 has a shape in which a quadrangular columnar-shaped material having a rectangular cross-sectional shape is twisted around the center axis thereof by approximately 90° at the twist portion 222.

In addition, the air guiding surface 221 is formed further towards the tip side than the twist portion 222 is. The twist portion 222 is preferably formed further towards the base side than the spark discharge gap G is. As a result, the air guiding surface 221 can be formed in the plug axial-direction position throughout the overall spark discharge gap G. Furthermore, the twist portion 222 is more preferably formed further towards the base side than the tip of the insulator 3 is.

As shown in FIG. 14, of the cross-sectional shape of the tip projecting portion 22 at the plug axial-direction position closest to the spark discharge gap G, the plug radial-direction width W20 is longer than the plug circumferential-direction width W2. In the present example, the above-described cross-sectional shape is the cross-sectional shape of the tip projecting portion 22 in the plug axial-direction position equivalent to that of the spark discharge gap G, and the shapes have a relationship in which W20>W2. In other words, in the portion of the tip projecting portion 22 in which the air guiding surface 221 is formed, W20>W2.

In addition, the tip projecting portion 22 projects further towards the inner circumferential side than the inner circumferential surface of the tip portion 21 of the housing 2 is, in the portion in which the air guiding surface 221 is formed, but does not project towards the outer circumferential side. Furthermore, the tip projecting portion 22 has a part which is further towards the base side than the twist portion 222 is, and, in the part, the plug circumferential-direction width is larger than the plug radial-direction width.

Other aspects are similar to those of the first example. Among the reference signs used in the drawings related to the present example, reference signs that are the same as those used in the first example indicate constituent elements and the like that are similar to those of the first example, unless particularly indicated otherwise.

In the case of the present example, in the portion of the tip projecting portion 22 that is further towards the base side than the twist portion 222 is, the plug circumferential-direction width is larger than the plug radial-direction width. Therefore, the tip projecting portion 22 can be joined to the tip portion 21 of the housing 2 with a wide joining surface. Thus, the joining strength of the tip projecting portion 22 to the housing 2 can be improved.

On the other hand, in the portion in which the air guiding surface 221 is formed, the plug radial-direction width W20 is longer than the plug circumferential-direction width W2. Therefore, the area of the air guiding surface 221 can be increased and the guidance function can be improved.

In addition, working effects similar to those of the first example are achieved.

Third Example

Figure 16:
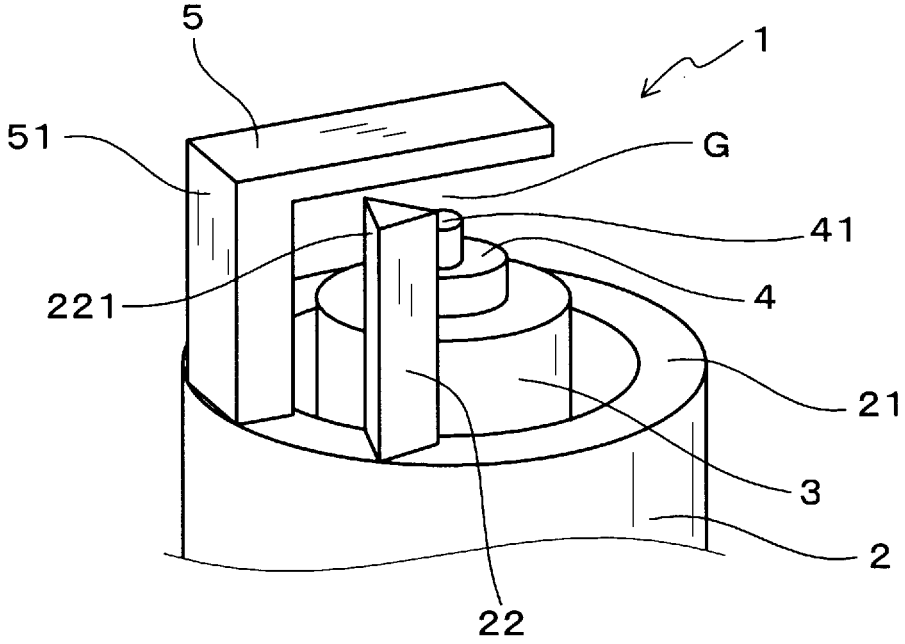
FIG. 16 is a perspective view of the tip portion of the spark plug in a third example.
Figure 17:
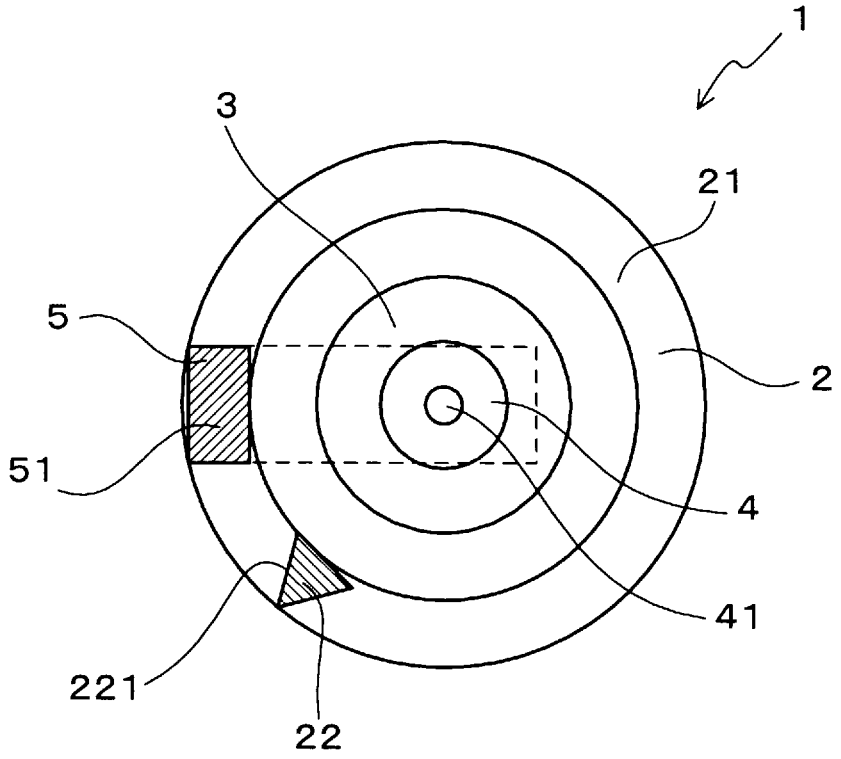
FIG. 17 is a cross-sectional view of the spark plug in the plug axial-direction position equivalent to that of the spark discharge gap, in the third example.

As shown in FIG. 16 and FIG. 17, the present example is an example in which the shape of the cross-section of the tip projecting portion 22 taken along a plane perpendicular to the plug axial direction is a triangle. In other words, the tip projecting portion 22 has a triangular columnar shape.

In the present example, in particular, the above-described cross-sectional shape is an equilateral triangle. The air guiding surface 221 is formed on one face of the tip projecting portion 22 corresponding to a side of the triangle.

Other aspects are similar to those of the first example. Among the reference signs used in the drawings related to the present example, reference signs that are the same as those used in the first example indicate constituent elements and the like that are similar to those of the first example, unless particularly indicated otherwise.

In the case of the present example, the tip projecting portion 22 can be more easily prevented from projecting inward and outward in the plug radial direction from the tip portion 21 of the housing 2, while forming the air guiding portion 221 that has a wide area in the tip projecting portion 22. Therefore, the guidance function of the tip projecting portion 22 can be improved while preventing problems regarding lateral flying sparks and problems regarding attachability to the internal combustion engine.

In addition, working effects similar to those of the first example are achieved.

Fourth Example

Figure 18:
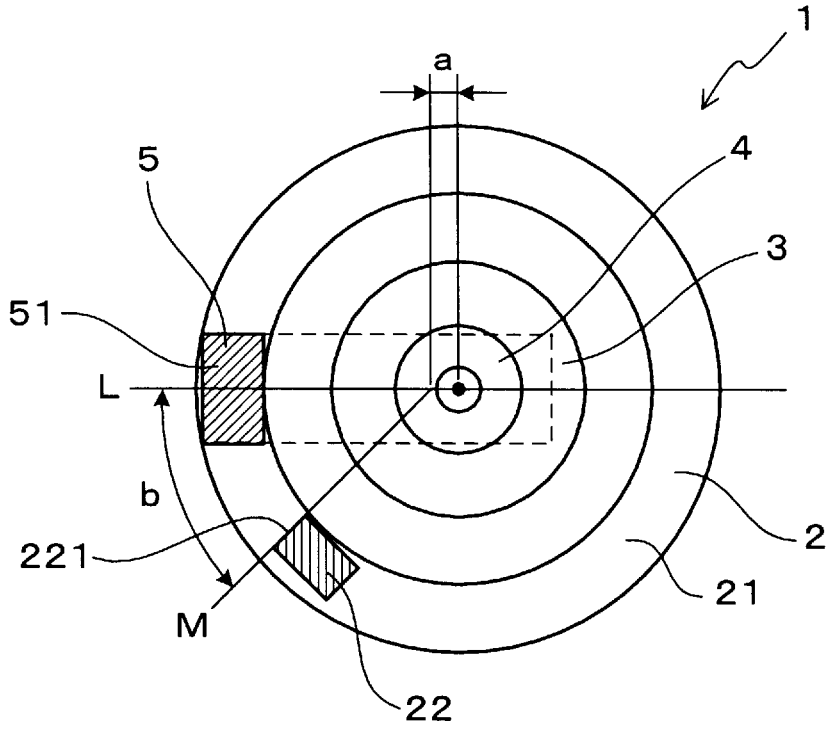
FIG. 18 is a cross-sectional view of the spark plug in the plug axial-direction position equivalent to that of the spark discharge gap, in a fourth example.

As shown in FIG. 18, the present example is an example in which the tip projecting portion 22 has a quadrangular columnar shape with a rectangular cross-section, and a face corresponding to the short side of the rectangle serves as the air guiding surface 221.

In this case, an extension line of the short side of the rectangle configuring the air guiding surface 221 of the tip projecting portion 22 serves as the straight line M. In addition, based thereon, the tip projecting portion 22 is disposed in the housing 2 so as to satisfy at least expression (1) to expression (4).

Other aspects are similar to those of the first example. Among the reference signs used in the drawings related to the present example, reference signs that are the same as those used in the first example indicate constituent elements and the like that are similar to those of the first example, unless particularly indicated otherwise.

In the case of the present example as well, working effects similar to those of the first example can be achieved.

The shape of the tip projecting portion 22 is not limited to those described in the above-described first example to fourth example, and various shapes can be used.

In addition, the tip of the tip projecting portion 22 can also be set further towards the base side than the spark discharge gap G is, as long as the function of the tip projecting portion 22 is realized. In this case, "the plug axial-direction position closest to the spark discharge gap G" is the tip portion of the tip projecting portion 22.

REFERENCE SIGNS LIST

1 spark plug
2 housing
21 tip portion
22 tip projecting portion
221 air guiding surface
3 insulator
4 center electrode
41 tip portion
5 ground electrode
51 erect portion
G spark discharge gap

What is claimed is:

1. A spark plug for an internal combustion engine comprising:

a cylindrical housing having an axial direction;

a cylindrical insulator that is held inside the housing;

a center electrode that is held inside the insulator so that a tip portion projects outwards;

a ground electrode that projects from a tip portion of the housing towards a tip side of the housing along the axial direction and forms a spark discharge gap between the ground electrode and the center electrode; and a tip projecting portion that projects from the tip portion of the housing towards the tip side, at a position differing from that of the ground electrode, wherein the tip projecting portion has a flat air guiding surface that faces the ground electrode side in a plug circumferential direction, and when viewed from a plug axial direction, when a straight line that connects the center, in the plug circumferential direction, of the erect portion of the ground electrode standing erect from the housing and a center point of the center electrode is a straight line, an extension line of the air guiding surface is a straight line, a distance between an intersection, between the straight line L and the straight line, and the center point of the center electrode is a, an angle formed by the straight line and the straight line M is b, a diameter of the housing is D, and the distance a is positive towards the side receding from the erect portion of the ground electrode and negative towards the side approaching the erect portion, all of expression to expression below are satisfied:

$$b \geq -67.8 \times (a/D) + 27.4 \quad (1)$$

$$b \leq -123.7 \times (a/D) + 64.5 \quad (2)$$

$$-0.4 \leq (a/D) \leq 0.4 \quad (3)$$

$$0° < b \leq 90° \quad (4).$$

2. The spark plug for an internal combustion engine according to claim 1, wherein:

expression (5) below is further satisfied:

$$b \leq -123.4 \times (a/D) + 53.7 \quad (5).$$

3. The spark plug for an internal combustion engine according to claim 2, wherein:

expression (6) below is further satisfied:

$$b \geq = 123.1 \times (a/D) + 30.0 \quad (6).$$

4. The spark plug for an internal combustion engine according to claim 2, wherein:

the tip of the tip projecting portion is positioned in a position equivalent to, or further towards the base side than, the tip of the ground electrode is, and a position equivalent to, or further towards the tip side than, the tip of the insulator is.

5. The spark plug for an internal combustion engine according to claim 2, wherein:

a plug circumferential-direction width of the tip projecting portion in a plug axial-direction position closest to the spark discharge gap is smaller than the erect portion of the ground electrode.

6. The spark plug for an internal combustion engine according to claim 2, wherein:

the tip projecting portion projects in parallel with the plug axial direction.

7. The spark plug for an internal combustion engine according to claim 2, wherein:

of a cross-sectional shape of the tip projecting portion in a plug axial-direction position closest to the spark discharge gap, a plug radial-direction width is longer than a plug circumferential-direction width.

8. The spark plug for an internal combustion engine according to claim 2, wherein:

a cross-sectional shape of the tip projecting portion at a plug axial-direction position closest to the spark discharge gap is a triangle.

9. The spark plug for an internal combustion engine according to claim 1, wherein:

expression (6) below is further satisfied:

$$b \geq = 123.1 \times (a/D) + 30.0 \quad (6).$$

10. The spark plug for an internal combustion engine according to claim 9, wherein:

the tip of the tip projecting portion is positioned in a position equivalent to, or further towards the base side than, the tip of the ground electrode is, and a position equivalent to, or further towards the tip side than, the tip of the insulator is.

11. The spark plug for an internal combustion engine according to claim 9, wherein:

a plug circumferential-direction width of the tip projecting portion in a plug axial-direction position closest to the spark discharge gap is smaller than the erect portion of the ground electrode.

12. The spark plug for an internal combustion engine according to claim 9, wherein:

the tip projecting portion projects in parallel with the plug axial direction.

13. The spark plug for an internal combustion engine according to claim 9, wherein:

of a cross-sectional shape of the tip projecting portion in a plug axial-direction position closest to the spark discharge gap, a plug radial-direction width is longer than a plug circumferential-direction width.

14. The spark plug for an internal combustion engine according to claim 9, wherein:

a cross-sectional shape of the tip projecting portion at a plug axial-direction position closest to the spark discharge gap is a triangle.

15. The spark plug for an internal combustion engine according to claim 1, wherein:

the tip of the tip projecting portion is positioned in a position equivalent to, or further towards the base side than, the tip of the ground electrode is, and a position equivalent to, or further towards the tip side than, the tip of the insulator is.

16. The spark plug for an internal combustion engine according to claim 1, wherein:

a plug circumferential-direction width of the tip projecting portion in a plug axial-direction position closest to the spark discharge gap is smaller than the erect portion of the ground electrode.

17. The spark plug for an internal combustion engine according to claim 1, wherein:

the tip projecting portion projects in parallel with the plug axial direction.

18. The spark plug for an internal combustion engine according to claim 1, wherein:

of a cross-sectional shape of the tip projecting portion in a plug axial-direction position closest to the spark discharge gap, a plug radial-direction width is longer than a plug circumferential-direction width.

19. The spark plug for an internal combustion engine according to claim 1, wherein:

a cross-sectional shape of the tip projecting portion at a plug axial-direction position closest to the spark discharge gap is a triangle.

* * * * *